US008967655B2

(12) United States Patent
Grilc et al.

(10) Patent No.: US 8,967,655 B2
(45) Date of Patent: Mar. 3, 2015

(54) SKI HAVING ASYMMETRIC CHARACTERISTICS

(75) Inventors: Luka Grilc, Ljubljana (SI); Marko Kozjek, Kamna Gorica (SI); Vinko Avgustin, Zirovnica (SI); Matej Bozicnik, Kamnik (SI)

(73) Assignee: Elan, D.O.O., Begunje na Goerenjskem (SI)

( * ) Notice: Subject to any disclaimer, the term of this patent is extended or adjusted under 35 U.S.C. 154(b) by 0 days.

(21) Appl. No.: 13/885,367

(22) PCT Filed: Nov. 7, 2011

(86) PCT No.: PCT/SI2011/000062

§ 371 (c)(1),
(2), (4) Date: Jun. 27, 2013

(87) PCT Pub. No.: WO2012/067589

PCT Pub. Date: May 24, 2012

(65) Prior Publication Data

US 2013/0270796 A1 Oct. 17, 2013

(30) Foreign Application Priority Data

Nov. 15, 2010 (SI) ..... 201000388

(51) Int. Cl.
*A63C 5/07* (2006.01)
*A63C 5/04* (2006.01)
(Continued)

(52) U.S. Cl.
CPC ..... *A63C 5/0411* (2013.01); *A63C 5/003* (2013.01); *A63C 5/0405* (2013.01); *A63C 5/12* (2013.01); *A63C 5/126* (2013.01)
USPC ..... 280/609; 280/602

(58) Field of Classification Search
CPC ..... A63C 5/06; A63C 5/07; A63C 5/04; A63C 5/00; A63C 9/00
USPC ..... 280/602, 609, 601, 608, 610, 611, 600, 280/607, 617
See application file for complete search history.

(56) References Cited

U.S. PATENT DOCUMENTS 2,510,794 A * 6/1950 Beerli ..... 280/609
4,343,485 A * 8/1982 Johnston et al. ..... 280/609
(Continued)

FOREIGN PATENT DOCUMENTS

FR 2517548 A1 6/1983
FR 2659562 A1 9/1991
FR 2248560 A1 11/2010

OTHER PUBLICATIONS

Written Opinion of the International Searching Authority/European Patent Office, for PCT/SI2011/000062, mailed Apr. 27, 2012.

*Primary Examiner* — Hau Phan
(74) *Attorney, Agent, or Firm* — Haynes and Boone LLP; William B. Nash; Joseph R. Mencher

(57) ABSTRACT

In order to assure smooth and essentially equidistant running of correspondingly loaded pair of skis over ground when turning left or right without any sideslip, a ski is bent at its tip at a pre-determined angle around its longitudinal axis and deflected from the ground by a radius along a that longitudinal axis. Despite a practically symmetric appearance of the circumference of such ski when observed in top view, the distance between a front inflection point and a rear inflection point on the left ski edge and the distance between the front inflection point and the rear inflection point on the right ski edge differ from each other such that the active lengths of the ski edges differ from each other. A weak area of the ski is provided adjacent at least one inflection point to provide different compression distributions between the ground and each of the ski edges.

20 Claims, 3 Drawing Sheets

(51) Int. Cl.
*A63C 5/00* (2006.01)
*A63C 5/12* (2006.01)

(56) References Cited

U.S. PATENT DOCUMENTS 5,002,300 A * 3/1991 Pascal et al. ..... 280/602
5,335,931 A * 8/1994 Lacroix et al. ..... 280/602
5,871,223 A * 2/1999 Zanco ..... 280/607
RE36,586 E * 2/2000 Abondance et al. ..... 280/602
6,499,758 B1 * 12/2002 Fournier ..... 280/609
7,111,864 B2 * 9/2006 Molg ..... 280/609
7,696,674 B2 * 4/2010 Roesler et al. ..... 310/358
7,798,514 B2 * 9/2010 Canaday et al. ..... 280/609
7,837,217 B2 * 11/2010 Avgustin et al. ..... 280/602
8,262,123 B2 * 9/2012 Smith et al. ..... 280/609
8,408,579 B2 * 4/2013 Bourgier et al. ..... 280/609
2001/0022439 A1 * 9/2001 Andrus et al. ..... 280/610
2001/0052679 A1 * 12/2001 Stubblefield ..... 280/609
2003/0141700 A1 * 7/2003 Turner et al. ..... 280/601
2003/0146599 A1 * 8/2003 Stefanova et al. ..... 280/609

* cited by examiner

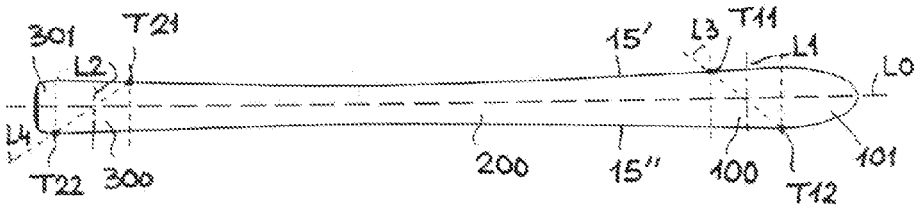
Fig. 5
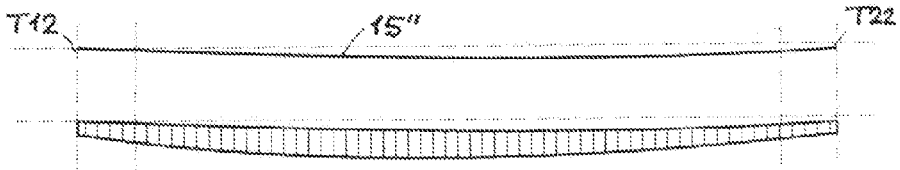
Fig. 7
Fig. 8
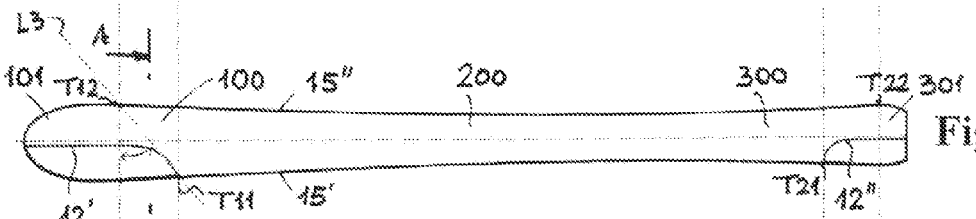
Fig. 6
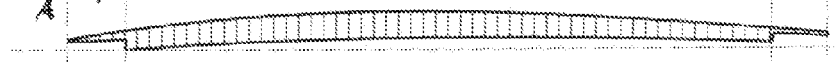
Fig. 10
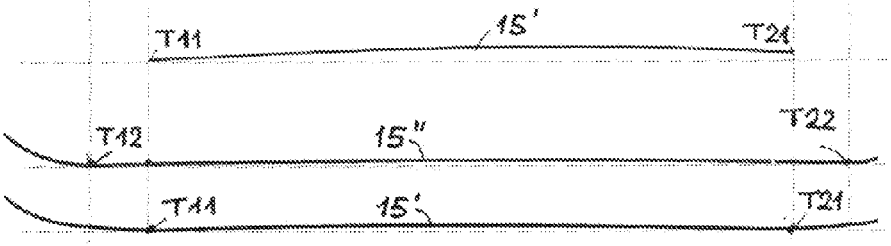
Fig. 9
Fig. 11
Fig. 12
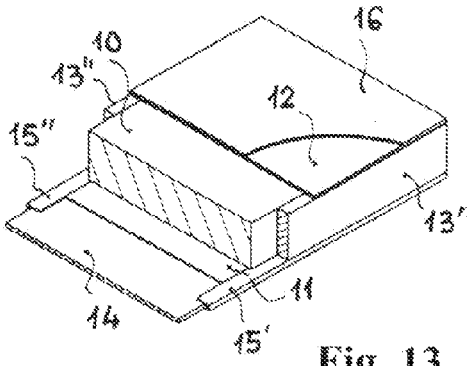
Fig. 13
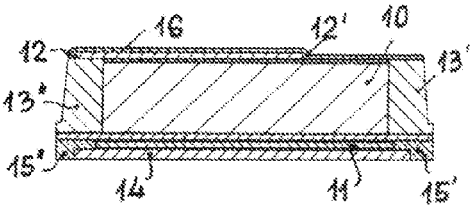
Fig. 14

SKI HAVING ASYMMETRIC CHARACTERISTICS

CROSS-REFERENCE TO RELATED APPLICATION

This application is a United States national phase application of co-pending international patent application number PCT/SI2011/000062, filed Nov. 7, 2011, which claims the benefit of Slovenia Application No. P-201000388 filed Nov. 15, 2010, of which is hereby incorporated by reference in its entirety.

The present disclosure is directed to sporting activities, namely to skiing, and in particular to measures related to adjusting stiffness of skis.

An embodiment of the present disclosure provides a ski, which despite to essentially unchanged dimensions and at least approximately symmetric visual appearance of the circumference in the top view, should have asymmetric characteristics in the sense of pre-determined and defined bending and torsion rigidity in the area of both ski edges, so that by turning the skis, the radius of the trajectory of running the left ski and the radius of the trajectory of running the right ski would be different and correlated in such manner, that by regular running of each pair of skis during turning left or right the trajectories of appropriately loaded right or left ski edges would remain at least approximately equidistant without any sideslip of anyone of the ski edges.

BACKGROUND

A ski is described in EP 1 484 091 B1 (Salomon S. A.), by which the radius of trajectory by running on the left ski edge differs from the radius of trajectory by running on the right ski edge. Such ski comprising a core, below which a bottom set of bearing layers is arranged, below which a sliding surface is available together with ski edges, and above said core there is a top set of bearing layers, above which appropriately decorated top covering layer is placed. The core and the top set of bearing layers are specially designed such that said set of bearing layers is inclined downwards along at least one lateral surface of the ski towards the corresponding ski edge. At least one layer of said set of layers is designed asymmetric, by which the ski is locally reinforced in a desired area on the one side of the longitudinal axis of the ski, so that its bending and/or torsion rigidity in said area is then higher than on the opposite side of said longitudinal axis. As known, a pair of skis is usually used. When by manufacturing of each pair of skis the same core is used in both skis, upon which several asymmetric layers are placed above such core, this should then lead to asymmetric visual appearance of the shape of such ski. Characteristics of such skis like bending and torsion stiffness in the area of the left and right ski edge, are then also asymmetric, in particular when asymmetric core is used by manufacturing of such ski, wherein also the visual appearance of such ski is quite obviously asymmetric. However, by means of just providing said asymmetric bearing layers it is impossible to assure that during regular turning such skis left or right, the running trajectories of both skis in each pair along the left or right ski edges would be at least essentially equidistant.

Furthermore, a ski is described in EP 0 661 086 (Skis Rossignol S. A.), which comprises a core, a bottom bearing layer located below said core and a top bearing layer located above the core. A sliding surface with ski edges is located below said bottom bearing layer, and the top covering layer is located above the top bearing layer. Said core is laterally covered by side walls. Said core is furnished with a strip, which in the area of the front portion and the rear portion of the ski extends parallel to said top bearing layer and bottom bearing layer, while in the central portion of the ski said strip is deflected i.e. inclined with respect to said top bearing layer and bottom bearing layer. Consequently, by loading such ski during the use, asymmetric bending and torsion deformations should be expected along both ski edges. In general, such approach should not lead to asymmetric visual appearance of the ski. It must however be taken into consideration that just slight deflection of said strip at e.g. several degrees of inclination cannot result in essential difference between the radius of the trajectory by turning such ski left or right. By increasing said inclination of the strip in the central portion of the ski, thickness of the core is essentially increased and consequently also the overall thickness of the ski in the central portion thereof, which results in elevation of the standing position and moreover also to essential increasing of stiffness and reduction of elasticity of the ski in the central portion thereof. Moreover, thanks to the shape of said strip, the front portion and the rear portion of the ski would theoretically have to be rotated relatively to the central portion of the ski as soon as the ski is exposed to compression and bending of the central region thereof. This on the one hand means that by running the ski straightforward, by bending the ski exclusively in the vertical direction, such ski automatically exposes tendency of turning and running out from said straightforward direction. On the other hand, when turning, the external ski of each pair of skis is usually exposed to much extensive loadings than the internal ski, which means that more extensive rotation of the front portion and the rear portion of the external ski results in running the ski along the trajectory with smaller radius, by which the external ski is rapidly approaching to the internal ski, which can be then corrected by means of appropriate sideslip of at least one ski edge, which leads to essential decrease of velocity and much more difficult control of the ski by turning.

Still further, CH 681 061 A5 (Haldemann) discloses a ski, which also comprises a core, a bottom bearing layer located below said core, ad a top bearing layer located above said core. A sliding surface with ski edges is located below said bottom bearing layer, and the top covering layer is located above the top bearing layer. Said core is laterally covered by side walls. For the purposes of increasing torsion rigidity of each ski in each pair of skis, a supplemental bearing layer is placed above the top bearing layer and extends asymmetrically with regard to the central longitudinal axis of each ski. When observing the left ski, said supplemental layer is placed over the central portion of the ski along the complete width, while on the front portion and the rear portion of the ski said supplemental layer is available exclusively above the region of the right ski edge. On the contrary, on the left ski, said supplemental layer is placed over the central portion of the ski along the complete width, while on the front portion and the rear portion of the ski said supplemental layer is available exclusively above the region of the left ski edge. Such measure results in increased torsion rigidity in the region of that ski edge, which is by turning the ski left or right more exposed to torsional deformations, which in particular by running the skis along the compact iced ground lead to sideslip of the loaded ski edge in combination with vibrations and similar undesired effects. Again, furnishing the ski with said supplemental layer, which is capable to essentially improve characteristics of the ski. leads to essential increasing of the thickness of the ski, and consequently also of its weight and bending rigidity. Those skilled in the art will understand, that also in this case such asymmetric concept unavoidable leads to amended visual appearance of the ski and asymmetric shape of the ski as such. It is also clear that just increasing of the torsion rigidity of the external ski in each pair of turning skis cannot contribute in the sense of reliable running of the external and the internal ski on approximately unchangeable distance apart from each other, since the above mentioned measures rather result in completely opposite effect.

A ski with asymmetric characteristics is disclosed in EP 2 248 560 A1 (Zai A G). The front and rear portion of such ski are torsionally bent around the longitudinal axis relative to the central portion, which results in various radius of curvature of the left and right ski edge when ski is loaded i.e. compressed with a pre-determined certain force. Such ski has not only asymmetric characteristics but also apparently asymmetric appearance, and is quite difficulty maintained in each desired direction along straightforwards sections of the skiing trajectory.

A further ski with asymmetric characteristics is disclosed in FR 2 659 562 A1 (Rossognol S A). Said asymmetric characteristic is achieved by means of removing a part of the front and rear portion of the ski, wherein the missing portions are then replaced with a non-bearing part, e.g. a plastic insert or the like, by which the appearance of an usual ski with a complete and symmetric silhouette shall be assured. Such ski has asymmetric characteristics but visually differs from ordinary skis. Besides, said non-bearing parts must be manufactured separately and in addition to other components of a ski, wherein also such modified ski must be further specially adapted for firmly and reliable attachment of said additional parts, in particular, since the ski as a whole is usually exposed to essential impacts and vibrations during the practical use.

SUMMARY

Embodiments of the present disclosure is directed to a ski having asymmetric characteristics, wherein such ski comprising a front portion with a tip, which is by appropriate radius bent away from the ground, a central portion, which is adapted for mounting a suitable ski binding used for attaching a ski shoe with said ski, as well as a rear portion with a tail. Moreover, when observed in a cross-section along each transversal line extending rectangular to the longitudinal axis thereof, such ski comprises a core, which is on the one hand interconnected with at least one bottom bearing layer, which is arranged on the bottom side thereof, which is faced towards the ground, and on the other hand with at least one top bearing layer, which is arranged on the top side thereof which is faced away from the ground, wherein said core is laterally covered by side walls, below which ski edges are located, between which and below each disposable bottom bearing layers a sliding surface is arranged, while said at least one top bearing layer is covered by at least one preferably decorated top covering layer. Said central portion of the ski is deflected away from the ground, so that the released ski is rest on the ground in the area of both ski edges and said sliding surface in the region of inflection points on said ski edges at least approximately within the area of maximal width of the front portion and the rear portion of the ski, namely along the left ski edge in the front inflection point between the tip and the deflected central portion, as well as in the rear inflection point between the deflected central portion and the tail on the rear portion of the ski, and along the right ski edge in the front inflection point between the tip and the deflected central portion, as well as in the rear inflection point between the deflected central portion and the tail on the rear portion.

Embodiments of the present disclosure provide that said ski is rotated in the area of the tip around its longitudinal axis at a pre-determined angle and is moreover bent by radius away from the ground along the line throughout the front inflection point on the left ski edge and the front inflection point on the right ski edge, wherein said line extends inclined with respect to said longitudinal axis extending along the rear portion, said central portion and said front portion of the ski, except of the tip, so that despite to visually symmetric silhouette of the ski in the top view thereof the distance between the front inflection point and the rear inflection point on the left ski edge differs from the distance between the front inflection point and the rear inflection point on the right ski edge, so that the active lengths of both ski edges differ from each other, wherein in each pair of skis the active length of the ski edge (located on the internal side of the ski is longer than the active length on the external side of the ski.

Moreover, in accordance with the invention embodiments of the present disclosure, the distances between the front inflection point and the rear inflection point on the left ski edge and between the front inflection point and the rear inflection point on the right ski edge are determined in such manner that the line, which extends throughout both front inflection points on the left and right ski edge on the front portion of the ski, and the line, which extends transversely i.e. perpendicularly to the longitudinal axis of the ski and parallel to the sliding surface define a pre-determined first angle, and that the line, which extends throughout both rear inflection points on the left and right ski edge on the rear portion of the ski, and the line, which extends transversely i.e. perpendicularly to the longitudinal axis of the ski and parallel to the sliding surface define a pre-determined second angle, wherein said first and second angle are equal to each other. On the contrary, said distances between the front inflection point and the rear inflection point on the left ski edge and between the front inflection point and the rear inflection point on the right ski edge are determined in such manner that the line, which extends throughout both front inflection points on the left and right ski edge on the front portion of the ski, and the line, which extends transversely i.e. perpendicularly to the longitudinal axis of the ski and parallel to the sliding surface define a pre-determined first angle, and that the line, which extends throughout both rear inflection points on the left and right ski edge on the rear portion of the ski, and the line, which extends transversely i.e. perpendicularly to the longitudinal axis of the ski and parallel to the sliding surface define a pre-determined second angle, wherein said first and second angle are different with respect to each other. Moreover, an embodiment further provides that the area between the inflection points on each ski edge having smaller active length is located within the area which is limited by said transversal lines, while on the contrary the area between the inflection points on each ski edge having bigger active length extends beyond the area which is limited by said transversal lines.

Moreover, embodiments of the present disclosure provide that each desired radius of curvature of the trajectory by turning left or right the ski is pre-determined by means of defining the line, around which the tip is bent, relatively to the longitudinal axis of the ski, namely by means of determining position of the inflection points on the left ski edge and the inflection points on the right ski edge, so that by turning each pair of skis due to different effective lengths between each pair of inflection points on said ski edges the radius of curvature of the trajectory of each external ski is larger than the radius of curvature of the trajectory of each internal ski, wherein said inflection points on both skis in each pair of skis are mirror symmetric.

Besides, for the purposes of obtaining different active lengths of the left ski edge and the right ski edge, namely distances between the front inflection point and the rear inflection point on the left ski edge and between the front inflection point and the rear inflection point on the right ski edge, a local weak area is foreseen on at least one of each disposable bearing layers in the region of inflection points on that ski edge, which should have shorter active length, by which correspondingly also distributions of compression of both ski edges towards the ground differ from each other. The local weak area can be foreseen on the front portion of the ski, namely in the region of the front inflection point of the ski edge having shorter active length, and that at least one further weak area can be foreseen on the rear portion of the ski, namely in the region of the rear inflection point of the ski edge having shorter active length, so that the active length of relevant ski edge at least approximately corresponds to the distance between said local weak areas. Said local weak area can be a cutout in the top bearing layer of the ski, or a cutout in the top bearing layer and also in the bottom bearing layer of the ski.

In a further embodiment of the present disclosure, the top bearing layer of the ski, which is furnished with a local weak area arranged on the front portion of the ski as well as with the local weak area arranged on the rear portion of the ski, is further combined with at least one supplemental bearing layer having inclined end portions, wherein the length of each upper supplemental bearing layer is smaller than the length of each lower supplemental bearing layer, and wherein each inclined end portion is cut in such manner that the length of each supplemental bearing layer on that side with respect to the longitudinal axis of the ski, where the local weak area is located, is smaller than its length on the opposite side of said longitudinal axis. In a still further embodiment, the local weak area, which is foreseen on the front portion of the ski in the region of the front inflection point on the ski edge having shorter active length, as well as at least one further local weak area, which is foreseen on the rear portion of the ski in the region of the rear inflection point on the ski edge having shorter active length, are available as recesses, which extend at least approximately perpendicular with respect to the sliding surface. Preferably, the said weak area in the form of a recess, which is available on the front portion of the ski in the region of the front inflection point, initially extends in the longitudinal direction of the ski apart from the first ski edge and towards the tip, upon which it passes the longitudinal axis of the ski in the area of a sinusoidal or S-shaped transition in order to continue in the longitudinal direction of the ski and apart from the second ski edge towards the tip, while the other weak area in the form of a recess, which is available on the rear portion of the ski in the region of the rear inflection point, initially extends in the longitudinal direction of the ski apart from the first ski edge and towards the tail, upon which it passes the longitudinal axis of the ski in the area of a sinusoidal or S-shaped transition in order to continue in the longitudinal direction of the ski and apart from the second ski edge towards the tail. In the one embodiment, the weak area in the form of a recess is foreseen on the top bearing layer of the ski, but in another embodiment said weak area in the form of a recess is foreseen on the top bearing layer and also in the area of the core of the ski, and in a still further embodiment the weak area in the form of a recess is foreseen on the top bearing layer and also in the area of the core and the bottom bearing layer of the ski.

BRIEF DESCRIPTION OF DRAWINGS

The present disclosure will be described by means of embodiments, which are shown in the enclosed drawings, wherein

FIG. 5 is a bottom view of the ski according to FIG. 1

FIG. 6 is a top view of an embodiment of the ski according to FIGS. 1 and 2;

FIG. 7 is active length of a released right ski edge of the ski according to FIG. 6;

FIG. 8 shows compression below the loaded right ski edge of the ski according to FIG. 6;

FIG. 9 is active length of a released left ski edge of the ski according to FIG. 6;

FIG. 10 shows compression below the loaded left ski edge of the ski according to FIG. 6;

FIG. 11 is a schematic presentation of the right ski edge of the ski according to FIG. 6;

FIG. 12 is a schematic presentation of the left ski edge of the ski according to FIG. 6;

FIG. 13 is an explosion view of the ski in the area of the line A-A;

FIG. 14 is a cross-section of the ski along the line A-A;

DETAILED DESCRIPTION

Figure 1:
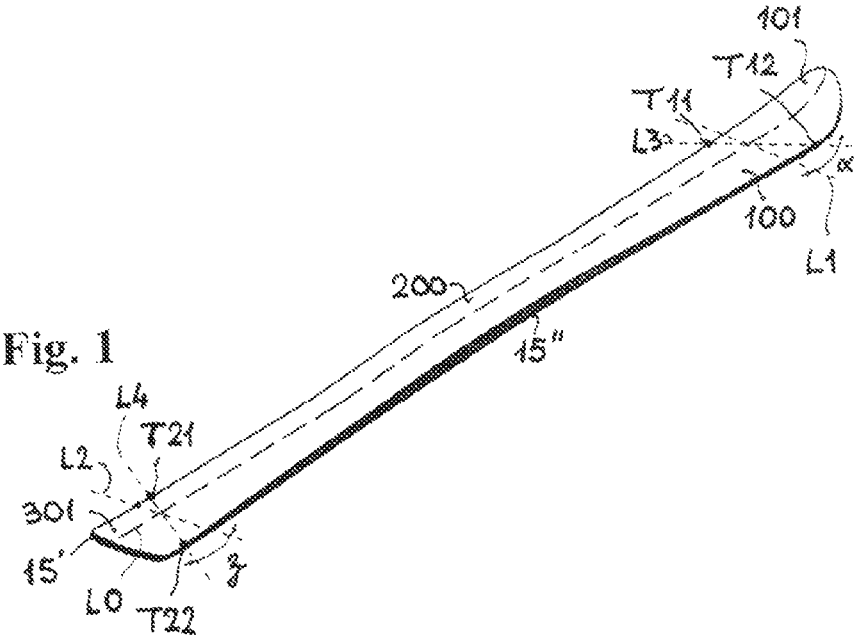
FIG. 1 is a perspective view of a ski having asymmetric characteristics.

A ski (FIG. 1) according to an embodiment of the present disclosure is a relatively elastic and deformable bending-torsion beam, which comprises a front portion 100, which is bent apart from the ground P, a central portion 200, which is adapted for attachment of a ski shoe, as well as a rear portion 300. Said bending-torsion characteristics of each ski are merely assured thanks to appropriate structure of the ski, in particular to a core 10 (FIGS. 13 and 14), below which, on the side facing to the ground P, at least one bottom bearing layer 11 is placed, and above which at least one top bearing layer 12 is arranged. Said core 11 is laterally covered by side walls 13', 13", below which ski edges 15', 15" are located, namely the left ski edge 15' and the right ski edge 15", between which a sliding surface 14 is arranged, which is correspondingly located below said bottom bearing layer 11. The top bearing layer 12 is covered by a top covering layer 16, which is preferably decorated and intended to protect together with said side walls 13', 13" the core 10 and the bearing layers 11, 12 against the external influences. Thanks to the distance between the bottom and top bearing layer 11, 12, which is maintained by means of said core 10, appropriate bending rigidity of the ski is assured, and also each desired torsion rigidity is obtained by means of corresponding shape and strength of said bearing layers 11, 12.

Each of said ski edges 15', 15" generally extends continuously along the complete length of the ski, starting from the tip 101 in the front portion 100, throughout the central portion 200 towards the end portion i.e. a tail 301 on the rear portion 300. Generally, the ski includes its central portion 200 deflected away from the ground P, wherein each ski edge 15', 15" extends from the tip 101 towards the deflection in the central portion 200 through a front inflection point T11, T12, and in the rear portion 300 of the ski from said deflection into a relatively straight or even slightly away from the ground P deflected end portion 301 through the rear inflection point T21, T22. As evident e.g. in FIGS. 11 and 12, on the left ski edge 15' there are the front inflection point T11 and the rear inflection point T21, while on the right ski edge 15" there are the front inflection point T12 and the rear inflection point T22.

Figure 2:
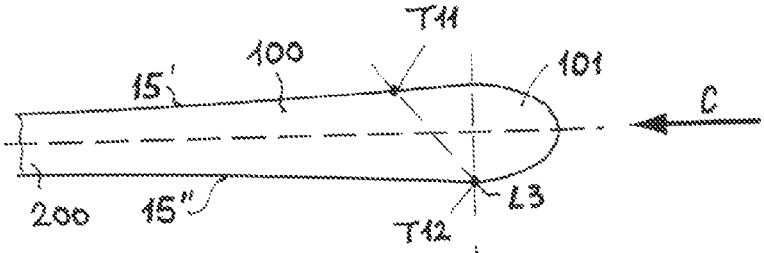
FIG. 2 is a top view of the front portion of the ski according to FIG. 1.
Figure 3:
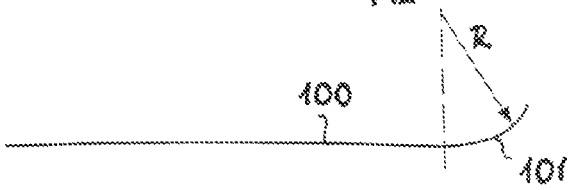
FIG. 3 is a top view of schematically shown front portion of the ski according to FIG. 1.
Figure 4:
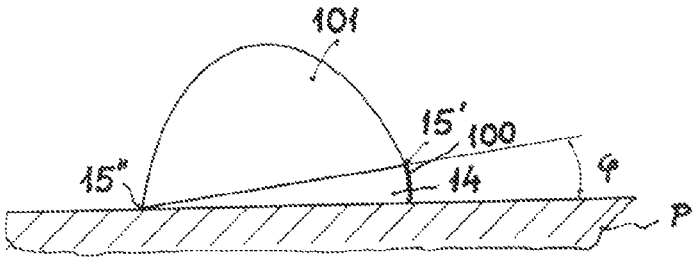
FIG. 4 is a front view of the ski according to FIG. 1 i.e. along the arrow C in FIG. 2.

An embodiment provides that the front portion 100 of the ski (FIGS. 2 and 4) is rotated around the longitudinal axis L0 at a pre-determined angle $\phi$ and is deflected apart from the ground P with the radius R along the line L3, which extends inclined with respect to said longitudinal axis L0 passing through the rear portion 300, central portion 200 and the front portion 100 except of the tip 101, namely through the front inflection point T11 of the left ski edge 15' and the front inflection point T12 of the right ski edge 15", by which despite the visually approximately symmetric appearance of the silhouette of the ski in the top view the distance between the front inflection point T11 and the rear inflection point T21 of the left ski edge 15' differs from the distance between the front inflection point T12 and the rear inflection point T22 of the right ski edge 15", and by which the active lengths of both ski edges 15, 15" differ from each other.

The active length of the left ski edge 15', which is shown in FIG. 9, corresponds to the distance between inflection points T11, T21, in which the released ski is rest on the ground P. Quite analogously, the active length of the right ski edge 15" is shown in FIG. 7 and corresponds to distance between inflection points T12, T22, in which the released ski is rest on the ground P. The ski according to an embodiment is characterized by the fact that despite to approximately symmetric appearance of the silhouette of the ski in the top view active lengths of both ski edges 15', 15" differ from each other, so that the distance between the inflection points T11, T21 of the left ski edge 15' in the front area 100 and the rear area 300 differs from the distance between the inflection points T12, T22 on the rear ski edge 15" in the front area 100 and the rear area 300 of the ski. In this, said distances between the inflection points T11, T21 on the left ski edge 15' and the inflection points T12, T22 on the rear ski edge 15" are determined in such way that the line L3 through the inflection points T11, T12 of the left and right ski edge 15', 15" in the front portion 100 of the ski together with the line L1, which extends in a transversal direction through the section of said line L3 and the longitudinal axis L0 of the ski, defines an angle $\alpha$, while the line L4 through the inflection points T21, T22 of the left and right ski edge 15', 15" in the rear portion 300 of the ski together with line L2 extending in a transversal direction of the ski through the section of said line L4 and the longitudinal axis L0 of the ski defines an angle $\beta$. Said angles $\alpha$ and $\beta$ may be equal to each other, which is however not compulsory. By taking into consideration said transversal lines L1, L2 in the front and rear area 100, 300 of the ski, the shorter active length of the ski edges 15', 15" between each inflection points T11, T12; T21, T22 falls within the area between said transversal lines L1, L2, while the longer active length of the ski edges 15', 15" between the inflection points T11, T12; T21, T22 exceeds the area which is limited with said transversal lines L1, L2. As a consequence of such concept of the ski having such different active lengths of ski edges 15', 15" between each inflection points T11, T12; T21, T22, the radius of trajectory by turning the ski left differs from the radius of trajectory by turning the ski right, wherein by simultaneously turning each pair of skis the radius of trajectory of each external ski is greater than the radius of trajectory of each internal ski in such extent that by turning each pair of skis, each time internal ski and each time external ski are running approximately equidistant from each other. Those skilled in the art will understand that each radius of curvature of the trajectory of the ski by turning depends on each appropriate position of said inflection points T11, T21 on the lefts ski edge 15' as well as the inflection points T12, T22 on the right ski edge 15", namely at least on position of the line L3 between the front inflection points T11, T12 on ski edges 15', 15" and the angle $\phi$ of rotation of the tip 101 relatively to the longitudinal axis L0 of the ski. It should also be understood that said inflection points T11, T12, T21, T22 on both skis in each pair of skis are mirror symmetric.

According to an embodiment, the above described concept of the ski is realized in a relatively simple manner and preferably in combination with corresponding weak areas 12', 12" on at least one of said bearing layers 11, 12 adjacent to said inflection points T11, T12 on the ski edge 15', 15" having shorter active length, namely the distance between both inflection points T11, T12, T21, T22. Consequently, said weak area 12', 12" can be established by means of a cutout in the top bearing layer 12 (FIGS. 6 and 15) in the region closely to the inflection points T11, T12, T21, T22 on the one of ski edges 15', 15" on the front portion 100 or the rear portion 300 of the ski, and optionally in combination with appropriately designing each residual bearing layers 121, 122, 123, 124. 125 (FIG. 16), or also by means of a recess (FIGS. 17-20) in the area of said inflection points T11, T12, T21, T22 on the ski edges 15, 15". All these possibilities will be described in more detail subsequently.

Figure 15:
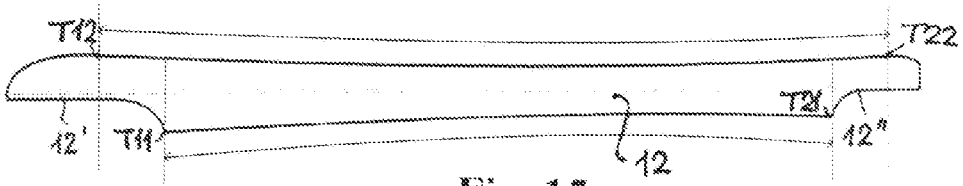
FIG. 15 is presentation of a top bearing layer of the embodiment according to FIG. 6.

In order to reduce active length of the left ski edge 15', in the embodiment shown in FIGS. 6 and 15 the top bearing layer 12 is furnished with two weak areas 12', 12" in the form of cutouts, which are arranged adjacent to the front inflection point T11 and the rear inflection point T21. The presence of said weak areas 12', 12" among others results in distribution of the compression towards the ground P in the area of ski edges 15, 15", as shown in FIGS. 8 and 10. Torsional deformations of the front and rear portion 100, 300 of the ski merely depend on the width of the ski in relevant area, as well as on the torsion rigidity of the ski in said areas 100, 300. By weakening of at least one bearing layer 11, 12 in the front portion 100 and/or the rear portion 300 of the ski, more precisely in the adjacency of each relevant inflection points T11, T12, T21, T22 of each corresponding ski edge 15', 15", the torsion rigidity is locally reduced, by which the active length of the ski edge 15', 15" is reduced, along which the compression is generated by the ski edge 15', 15", by which the radius of trajectory of the ski by turning is correspondingly changed. In order to assure different characteristics of skis, said weak areas 12', 12" can be different. Regarding said longitudinal axis L0 of the ski, said weak areas 12', 12" can be completely located on the one side of said longitudinal axis L0, or at least a majority of the surface of the weak area 12', 12" is available on that side of said longitudinal axis L0, which corresponds to the outer side in each pair of skis, while the residual portion of said weak area 12', 12", which should not exceed e.g. 10% to 40% of complete surface thereof, may also be located on the opposite side of the longitudinal axis L0.

Figure 16:
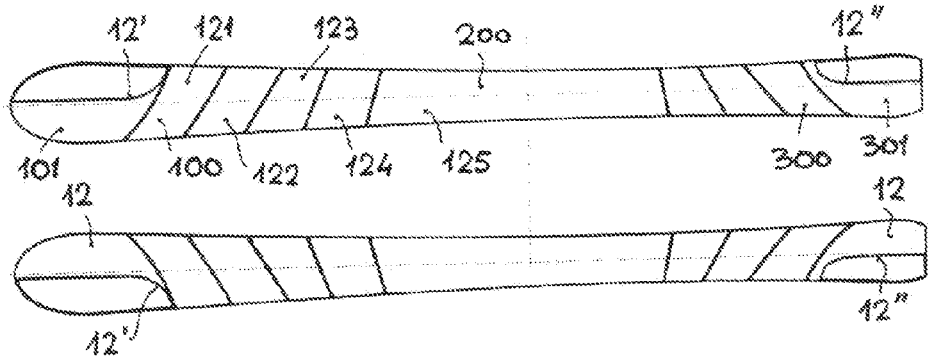
FIG. 16 presents a pair of skis corresponding to a further embodiment.
Figure 17:
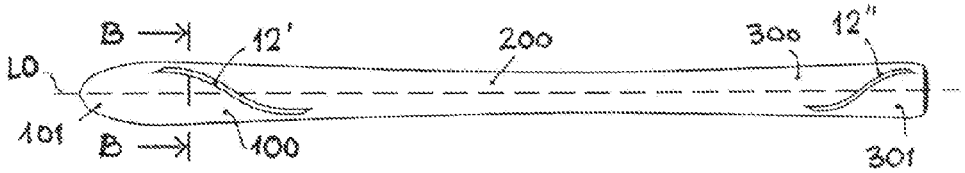
FIG. 17 presents a still further embodiment.
Figure 18:
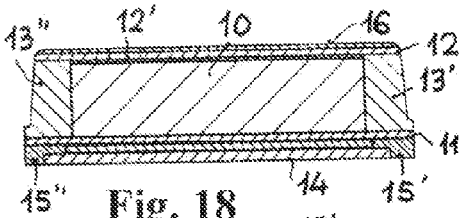
FIG. 18 is a cross-section of a ski according to FIG. 17 along the line B-B.
Figure 19:
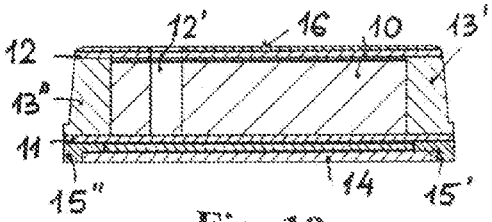
FIG. 19 is a cross-section of a further embodiment of a ski according to FIG. 17 along the line B-B.
Figure 20:
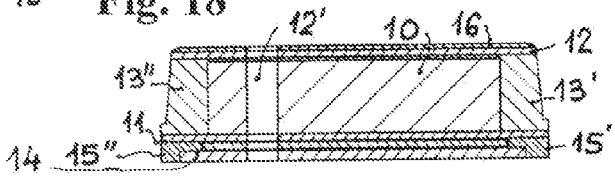
FIG. 20 is a cross-section of a still further embodiment of a ski according to FIG. 17 along the line B-B.

In accordance with an embodiment, which is shown in FIG. 16, the weak area 12', 12" on at least one of the bearing layers 11, 12 is combined with the presence of further supplemental bearing layers 121, 122, 123, 124, 125, which extend from the central region 200 of the ski towards the front portion 100 and the rear portion 300 and which are each per se ended with inclined edges facing towards said front portion 100 and rear portion 300 of the ski, wherein the angles of inclination of said edges on layers 121, 122, 123, 124, 125 relatively to each transversal line L1, L2 are step-like gradually increasing in a direction towards the front portion 100 and the rear portion 300 of the ski synchronously with arrangement of said weak areas and lines L3, L4 which are inclined relatively to the longitudinal axis L0. Those skilled in the art will understand that increasing of said angle of inclination of said edges also introduces asymmetric characteristics and weakening in the sense of local reduction of bending and torsion rigidity of the ski.

In accordance with a still further embodiment, the ski is furnished with a weak area 12', 12" in the form of a recess (FIGS. 17-20), which extends rectangular with respect to the sliding surface 14 towards the interior of the ski. Said weak area 12' in the form of a recess is available on the front portion 100 of the ski in the area of inflection points T11, T12, and extends initially in the longitudinal direction of the ski apart from the first ski edge 15' towards the tip 101, upon which it is deflected in a sinusoidal manner or in the shape of letter S in order to pass the longitudinal axis L0 of the ski in a direction towards the opposite ski edge 15" and continues apart from it towards the tip 101. Quite analogously, the other weak area 12" in the form of a recess extends along the rear portion 300 of the ski, initially in the longitudinal direction of the ski and apart from the first ski edge 15' towards the tail 301, upon which it passes the longitudinal axis L0 of the ski in the area of a sinusoidal or S-shaped transition in order to continue apart from the second ski edge 15" in a direction towards the tail 301 on the rear portion 300 of the ski. The first possible variation provides that such weak area 12', 12" in the form of a recess is foreseen exclusively in the top bearing layer 12 (FIG. 18); the second possible variation (FIG. 19) provides that such weak area 12', 12" is available both in the top bearing layer 12 and the core 10, whilst the third variation (FIG. 20) provides that said weak area 12', 12" is available in the top bearing layer 11, in the core 10 and also in the bottom bearing layer 11.

The invention claimed is:

1. A ski, comprising:

an elongated ski base including a front portion, a rear portion located opposite the base from the front portion, a first side extending between the front portion and the rear portion, and a second side extending between the front portion and the rear portion and located opposite the base from the first side;

a first side front inflection point located on the front portion of the base and adjacent the first side of the base;

a first side rear inflection point located on the rear portion of the base and adjacent the first side of the base, wherein the first side rear inflection point is spaced apart from the first side front inflection point by a first distance;

a second side front inflection point located on the front portion of the base and adjacent the second side of the base;

a second side rear inflection point located on the rear portion of the base and adjacent the second side of the base, wherein the second side rear inflection point is spaced apart from the second side front inflection point by a second distance that is greater than the first distance; and a weak area provided in the base adjacent at least one of the first side front inflection point and the first side rear inflection point, wherein the weak area is operable to result in a first force distribution from the first side of the base to a surface that differs from a second force distribution from the second side of the base to a surface.

2. The ski of claim 1, wherein a first weak area is provided in the base adjacent the first side front inflection point, and a second weak area is provided in the base adjacent the first side rear inflection point.

3. The ski of claim 1, wherein the base includes a top bearing layer and the weak area includes a cutout in the top bearing layer.

4. The ski of claim 1, wherein the base includes a top bearing layer and a bottom bearing layer, and wherein the weak area includes a first cutout in the top bearing layer and a second cutout in the bottom bearing layer.

5. The ski of claim 1, wherein the base includes a top bearing layer and the weak area includes a cutout in the top bearing layer, and wherein the ski further comprises:

at least one supplemental bearing layer located adjacent the cutout in the top bearing layer, wherein each at least one supplemental bearing layer includes a first edge that forms an acute angle with a longitudinal axis of the base and a second edge that is located opposite that at least one supplemental bearing layer from the first edge and that is shorter than the first edge.

6. The ski of claim 1, wherein the weak area includes a recess in the base that is oriented substantially perpendicularly relative to a bottom surface of the base.

7. The ski of claim 1, wherein the weak area includes a substantially sinusoidal-shaped recess that extends along a portion of the length of the base and that crosses a longitudinal axis of the base.

8. The ski of claim 7, wherein the base includes a top bearing layer and the weak area includes the sinusoidal-shaped recess in a portion of the top bearing layer.

9. The ski of claim 7, wherein the base includes a core and a top bearing layer and the weak area includes the sinusoidal-shaped recess in a portion of the top bearing layer and a portion of the core.

10. The ski of claim 7, wherein the base includes a core, a top bearing layer, and a bottom bearing layer located opposite the core from the top bearing layer, and wherein the weak area includes the sinusoidal-shaped recess in a portion of the top bearing layer, a portion of the core, and a portion of the bottom bearing layer.

11. A set of skis, comprising:

a first ski that is operable to couple to a first ski shoe of a user, wherein the first ski includes an elongated first ski base having a first ski front portion, a first ski rear portion located opposite the first ski base from the first ski front portion, a first ski outer side extending between the first ski front portion and the first ski rear portion, and a first ski inner side extending between the first ski front portion and the first ski rear portion and located opposite the first ski base from the first ski outer side, and wherein the first ski further includes:

a first ski outer side front inflection point located on the first ski front portion of the first ski base and adjacent the first ski outer side of the first ski base;

a first ski outer side rear inflection point located on the first ski rear portion of the first ski base and adjacent the first ski outer side of the first ski base, wherein the first ski outer side rear inflection point is spaced apart from the first ski outer side front inflection point by a first distance;

a first ski inner side front inflection point located on the first ski front portion of the first ski base and adjacent the first ski inner side of the first ski base;

a first ski inner side rear inflection point located on the first ski rear portion of the first ski base and adjacent the first ski inner side of the first ski base, wherein the first ski inner side rear inflection point is spaced apart from the first ski inner side front inflection point by a second distance that is greater than the first distance; and a first ski weak area provided in the first ski base adjacent at least one of the first ski outer side front inflection point and the first ski outer side rear inflection point, wherein the first ski weak area is operable to result in a first ski inner side force distribution from the first ski inner side of the first ski base to a surface that differs from a first ski outer side force distribution from the first ski outer side of the first ski base to the surface; and a second ski that is operable to couple to a second ski shoe of a user, wherein the second ski includes an elongated second ski base having a second ski front portion, a second ski rear portion located opposite the second ski base from the second ski front portion, a second ski outer side extending between the second ski front portion and the second ski rear portion and that faces away from the first ski when the first ski is coupled to the first ski shoe and the second ski is coupled to the second ski shoe, and a second ski inner side extending between the second ski front portion and the second ski rear portion, located opposite the second ski base from the second ski outer side, and that faces towards the first ski when the first ski is coupled to the first ski shoe and the second ski is coupled to the second ski shoe, and wherein the second ski further includes:

a second ski outer side front inflection point located on the second ski front portion of the second ski base and adjacent the second ski outer side of the second ski base;

a second ski outer side rear inflection point located on the second ski rear portion of the second ski base and adjacent the second ski outer side of the second ski base, wherein the second ski outer side rear inflection point is spaced apart from the second ski outer side front inflection point by a third distance;

a second ski inner side front inflection point located on the second ski front portion of the second ski base and adjacent the second ski inner side of the second ski base;

a second ski inner side rear inflection point located on the second ski rear portion of the second ski base and adjacent the second ski inner side of the second ski base, wherein the second ski inner side rear inflection point is spaced apart from the second ski inner side front inflection point by a fourth distance that is greater than the third distance; and a second ski weak area provided in the second ski base adjacent at least one of the second ski outer side front inflection point and the second ski outer side rear inflection point, wherein the second ski weak area is operable to result in a second ski inner side force distribution from the second ski inner side of the second ski base to the surface that differs from a second ski outer side force distribution from the second ski outer side of the second ski base to the surface.

12. The set of skis of claim 11, wherein:

the first ski includes a first first ski weak area that is provided in the first base adjacent the first ski outer side front inflection point, and a second first ski weak area that is provided in the first ski base adjacent the first ski outer side rear inflection point; and the second ski includes a first second ski weak area that is provided in the second base adjacent the second ski outer side front inflection point, and a second second ski weak area that is provided in the second ski base adjacent the second ski outer side rear inflection point.

13. The set of skis of claim 11, wherein:

the first ski base includes a first ski top bearing layer and the first ski weak area includes a first ski cutout in the first ski top bearing layer; and the second ski base includes a second ski top bearing layer and the second ski weak area includes a second ski cutout in the second ski top bearing layer.

14. The set of skis of claim 11, wherein:

the first ski includes the first ski base including a first ski top bearing layer and a first ski bottom bearing layer, and wherein the first ski weak area includes a first first ski cutout in the first ski top bearing layer and a second first ski cutout in the first ski bottom bearing layer; and the second ski includes the second ski base including a second ski top bearing layer and a second ski bottom bearing layer, and wherein the second ski weak area includes a first second ski cutout in the second ski top bearing layer and a second second ski cutout in the second ski bottom bearing layer.

15. The set of skis of claim 11, wherein:

the first ski includes the first ski base having a first ski top bearing layer and the first ski weak area includes a first ski cutout in the first ski top bearing layer, and wherein the first ski further includes at least one first ski supplemental bearing layer located adjacent the first ski cutout in the first ski top bearing layer, wherein each at least one first ski supplemental bearing layer includes a first first ski supplemental bearing layer edge that forms an first ski acute angle with a first ski longitudinal axis of the first ski base and a second first ski supplemental bearing layer edge that is located opposite that at least one first ski supplemental bearing layer from the first ski supplemental bearing layer edge and that is shorter than the first ski supplemental bearing layer edge; and the second ski includes the second ski base having a second ski top bearing layer and the second ski weak area includes a second ski cutout in the second ski top bearing layer, and wherein the second ski further includes at least one second ski supplemental bearing layer located adjacent the second ski cutout in the second ski top bearing layer, wherein each at least one second ski supplemental bearing layer includes a first second ski supplemental bearing layer edge that forms an second ski acute angle with a second ski longitudinal axis of the second ski base and a second second ski supplemental bearing layer edge that is located opposite that at least one second ski supplemental bearing layer from the first second ski supplemental bearing layer edge and that is shorter than the first second ski supplemental bearing layer edge.

16. The set of skis of claim 11, wherein:

the first ski weak area includes a first ski recess in the first ski base that is oriented substantially perpendicularly relative to a first ski bottom surface of the first ski base; and the second ski weak area includes a second ski recess in the second ski base that is oriented substantially perpendicularly relative to a second ski bottom surface of the second ski base.

17. The set of skis of claim 11, wherein:

the first ski weak area includes a substantially sinusoidal-shaped first ski recess that extends along a portion of the length of the first ski base and that crosses a first ski longitudinal axis of the first ski base; and the second ski weak area includes a substantially sinusoidal-shaped second ski recess that extends along a portion of the length of the second ski base and that crosses a second ski longitudinal axis of the second ski base.

18. The set of skis of claim 17, wherein:

the first ski base includes a first ski top bearing layer and the first ski weak area includes the sinusoidal-shaped first ski recess in a portion of the first ski top bearing layer; and the second ski base includes a second ski top bearing layer and the second ski weak area includes the sinusoidal-shaped second ski recess in a portion of the second ski top bearing layer.

19. The set of skis of claim 17, wherein:

the first ski base includes a first ski core and a first ski top bearing layer and the first ski weak area includes the sinusoidal-shaped first ski recess in a portion of the first ski top bearing layer and a portion of the first ski core; and the second ski base includes a second ski core and a second ski top bearing layer and the second ski weak area includes the sinusoidal-shaped second ski recess in a portion of the second ski top bearing layer and a portion of the second ski core.

20. The set of skis of claim 17, wherein:

the first ski base includes a first ski core, a first ski top bearing layer, and a first ski bottom bearing layer located opposite the first ski core from the first ski top bearing layer, and wherein the first ski weak area includes the sinusoidal-shaped first ski recess in a portion of the first ski top bearing layer, a portion of the first ski core, and a portion of the first ski bottom bearing layer; and the second ski base includes a second ski core, a second ski top bearing layer, and a second ski bottom bearing layer located opposite the second ski core from the second ski top bearing layer, and wherein the second ski weak area includes the sinusoidal-shaped second ski recess in a portion of the second ski top bearing layer, a portion of the second ski core, and a portion of the second ski bottom bearing layer.

* * * * *